United States Patent [19]

Wulkowicz

[11] Patent Number: 4,727,371

[45] Date of Patent: Feb. 23, 1988

[54] TRAFFIC CONTROL SYSTEM AND DEVICES FOR ALLEVIATING TRAFFIC FLOW PROBLEMS AT ROADWAY JUNCTION

[76] Inventor: Robert M. Wulkowicz, 2801 W. Eastwood, Chicago, Ill. 60625

[21] Appl. No.: 813,588

[22] Filed: Dec. 26, 1985

[51] Int. Cl.[4] ..... G08G 1/07

[52] U.S. Cl. ..... 340/917; 340/905

[58] Field of Search ..... 340/905, 917, 919, 988, 340/989, 990, 22, 104

[56] References Cited

U.S. PATENT DOCUMENTS

| | | | |
|---|---|---|---|
| 3,275,984 | 9/1966 | Barker | 340/917 X |
| 3,304,539 | 2/1967 | Auer, Jr. | 340/920 |
| 3,384,869 | 5/1968 | Waldron | 340/919 X |
| 3,593,262 | 7/1971 | Spencer | 340/932 |
| 3,783,446 | 1/1974 | McGimpsey | 340/917 |
| 4,398,171 | 8/1983 | Dahan et al. | 340/22 |

*Primary Examiner*—James L. Rowland
*Assistant Examiner*—Brian R. Tumm
*Attorney, Agent, or Firm*—Edward J. Chalfie

[57] ABSTRACT

The present invention overcomes the inadequacies of prior traffic controls by providing a system for a traffic junction between vehicle paths which includes a first detector for detecting the position of a first vehicle along a first vehicle path. The system includes a dynamic roadway sign for displaying the junction, the vehicle paths and the relative position of the first vehicle to the junction. The dynamic roadway sign is positioned along a second vehicle path, to be visible to any vehicles on the second vehicle path approaching the junction. The dynamic roadway sign is positioned sufficiently prior to the junction to allow sufficient time for vehicles travelling on the second vehicle path to react without abrupt manuevers to avoid collision with the first vehicle at the junction. The dynamic roadway sign would include a graphic display of the junction for the vehicle paths, and icons positioned in sequence in one of the vehicle paths. Each of the icons is illuminated to indicate the presence of a vehicle at a pre-determined position on the vehicle path and its relative position to the junction.

17 Claims, 10 Drawing Figures

TRAFFIC CONTROL SYSTEM AND DEVICES FOR ALLEVIATING TRAFFIC FLOW PROBLEMS AT ROADWAY JUNCTION

BACKGROUND OF THE INVENTION

The present invention pertains to the traffic control systems and devices with means for controlling the speed and lane usage of traffic through informational messages directed to the conflicting drivers, with particular emphasis on the control of traffic where the drivers' vision is limited by the roadway construction or terrain features.

Roadways require free flow of traffic to avoid congestion and the resulting increase in driving times. Common impediments to traffic flow are junctions between two or more roadways. Safer and more efficient roadways are possible if traffic can be guided through these junctions.

One of the solutions to the traffic problems at junctions is the use of ramps to merge traffic onto or off of one roadway to another. Often the surrounding terrain does not permit one driver to directly view existing or merging vehicles when approaching a junction. Little time is left for the driver to react and avoid a collision. Even an abrupt avoidance manuever can cause an accident between adjacent or following vehicles who would have otherwise been unaffected by the merging vehicle.

A number of traffic devices have been developed, but are inadequate to control traffic safely and efficiently under all circumstances, especially when a direct view between merging vehicles is prohibited. For example, U.S. Pat. No. 3,304,539 granted to Auer discloses a freeway access ramp traffic control device which senses lane occupancy on a freeway, exit ramp and access ramp. A conventional red-green traffic signal controls vehicles entering the access ramp in response to congestion on the freeway in order to "meter" the flow of merging traffic onto the freeway. The system does not provide for informing the freeway drivers of the vehicles merging off the access ramp which could cause traffic slowdown and create the potential for collisions.

Another example of a traffic control system for junctions is disclosed in U.S. Pat. No. 3,593,262 granted to Spencer. An access ramp is lined with indicators to create a moving gap between vehicles on the access ramp to match available gaps in the freeway traffic. Again, the freeway drivers are not informed as to the volume or frequency of the merging traffic.

Some traffic control systems have used changeable signs to guide traffic from congested or obstructed roadways. One such system is disclosed in U.S. Pat. No. 3,275,984 granted to Barker. Motion detectors sense the slowdown of freeway traffic and signal the condition to remote signs upstream of the congestion. The signs are not dynamic and have only an on or off condition. They signal avoidance of a roadway rather than the avoidance of collision between individual vehicles merging or exiting the freeway.

SUMMARY OF THE INVENTION

The inadequacies of prior traffic controls are overcome by the inventive traffic control systems and dynamic signs. First, the information deficit encountered by a driver approaching a junction is alleviated by effectively increasing the time the driver has to percieve, appraise and respond to another vehicle entering the junction. Second, traffic is guided by a dynamic display of the relative position of the vehicle to the junction. Third, the system is psycologically reinforcing as traffic enters the junction and the accuracy of the display is proven by emergence of the other vehicle. Fourth, the present invention is simple to understand, easy to install and inexpensive to install and maintain.

The present invention includes a traffic control system for a traffic junction between a plurality of vehicle paths. The system includes first detecting means for detecting position of a first vehicle along a first vehicle path towards the junction and means for displaying the junction, the plurality of vehicle paths and the relative position of the first vehicle to the junction. The displaying means are positioned along a second vehicle path, to be visible to any vehicles on the second vehicle path approaching the junction. The displaying means are positioned sufficiently prior to the junction to allow sufficient time for vehicles travelling on the second vehicle path to react without abrupt manuevers to avoid collision with the first vehicle at the junction whereby the vehicles on the second vehicle path do not require a direct view of the first vehicle before the first vehicle enters the junction to avoid collision.

The present invention also includes a dynamic roadway junction sign as the preferred displaying means. The sign includes a graphic display of a junction and a plurality of vehicle paths with a plurality of icons positioned in sequence in one of the graphically displayed vehicle paths. Each of the icons is illuminated to indicate the presence of a vehicle at a pre-determined position along the vehicle path. The illuminated icon represents the relative position of the vehicle to the junction.

DETAILED DESCRIPTION OF THE DRAWINGS

DETAILED DESCRIPTION OF THE INVENTION

The present invention generally relates a traffic control system which promotes the safe and efficient use of roadways by alleviating the information deficit experienced by drivers approaching roadway junctions. Detectors are used to determine the position of a vehicle on a first vehicle path. This information is provided to any vehicles travelling on a second vehicle path so that collisions and abrupt manuevers can be avoided before the two vehicle paths intersect. Specific types of display systems will be discussed for relating information and guidance to drivers.

Figure 1A:
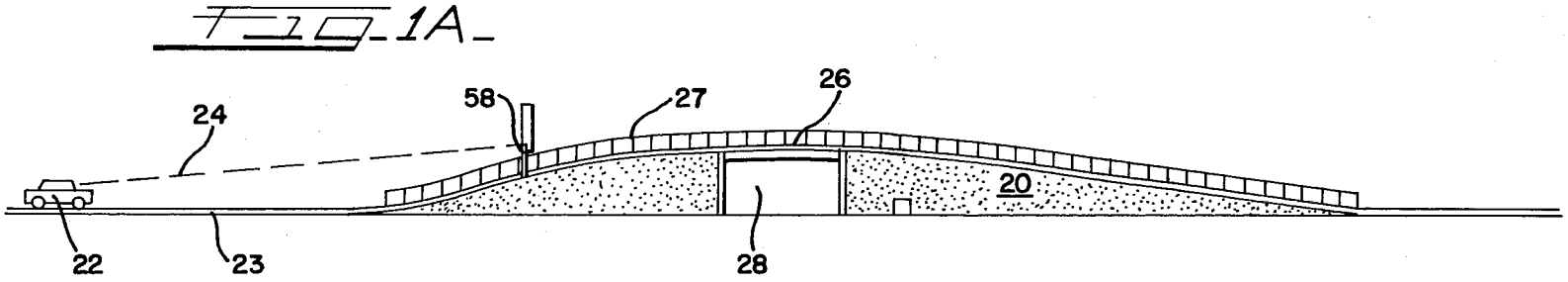
FIG. 1A is a cross-sectional view along lines 1A-1A in FIG. 1B traffic junction employing the inventive traffic control system.

The inforamtion deficit experienced by drivers is a blocking of their vision, for whatever reason, that keeps the driver from learning of the traffic conditions ahead. As illustrated in FIG. 1A, an overpass 20 blocks the view of the driver in vehicle 22 travelling along a freeway 23 whose line of sight 24 cannot extend over the apex 26 of the overpass 20. Overpasses of this nature are encountered frequently as the result of hills in the surrounding terrain or, as in this instance, as an overpass 20 over a crossroad 28.

Not until the vehicle 22 reaches the apex 26 of the hill 20, can the driver begin to perceive, appraise and respond to traffic conditions beyond the hill 20. A danger zone begins at that point where an accident is possible due to the vehicle 22 encountering a previously unknown traffic condition with little time to react. Conventional "passive" signs which advise or warn of traffic patterns ahead such as "merging traffic" are often ignored by drivers because of the infrequency and low volume of merging traffic. The few encounters with merging traffic for a driver offers little reinforcement as to the accuracy and credibility of the sign. Even flashing lights on the passive sign has no obvious positive effect on conveying useful information to the driver.

Figure 1B:
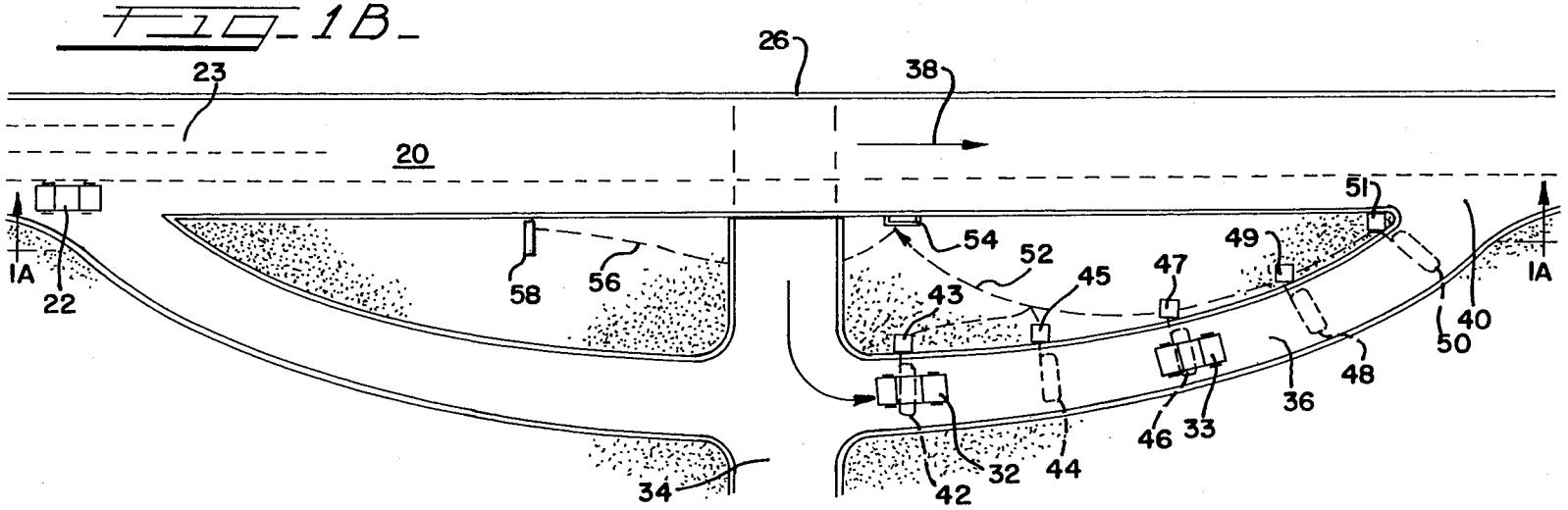
FIG. 1B is a plan view of the traffic junction in FIG. 1A employing the inventive traffic control system.

FIG. 1B is a plan view of the overpass 20 illustrated in FIG. 1A. A ramp vehicle 32 travelling on crossroad 34 must travel the length of an access ramp 36 before it can merge onto the freeway 23. As previously discussed, the freeway vehicle 22 travelling in the direction of arrow 38 cannot see the exit 40 of the access ramp 36 until it has passed over the apex 26 of the overpass 20. The freeway vehicle 22 also does not have a direct view of the access ramp 36 because of the difference in elevation between the apex 26 and the access ramp 36.

As the ramp vehicle 32 enters the access ramp 36 a detector 42 senses its position. A second detector 44 then senses the ramp vehicle's 32 position as it proceeds along the access ramp 36. Similarly, a third 46, fourth 48 and fifth detector 50 senses the progress of the ramp vehicle 32. The present invention contemplates the use of any conventional detector or other means to sense the position of a vehicle. Also, any number of detectors may be used. The details of selecting the number and type of detector applicable to suit a particular access ramp is well known. For instance, and not to be limited to, a suitable detector would be a loop vehicle detector. Federal APD Model DLD-10 and LD - 21. The detector 42,44,46,48 and 50 could be placed in cuts in the access ramp 36, in epoxy concrete and secure from effects of precipitation and snow removal techniques.

The detectors 42, 44, 46, 48 and 50 are connected through junctions 43, 45, 47, 49 and 51, respectively, by a cable 52 to a programmable controller 54 for assimilating data from the detectors. The controller 54 is mounted off the access ramp 36 in compliance with freeway distance standards. A suitable controller 54 for example, and not for limitation to, is a GE series 100 industrial grade programmable controller in a suitable NEMA rated enclosure with interior heating and absorbtion cooling as required by ambient conditions and equipment tolerances. Memory and calculating power may be increased as algorithms require and unit configurations vary. Again, the details of selecting the specific controller would be well-known. Although a combination of loop detector and programable controller has been described, the present invention contemplates other means for detecting or sensing the position of a vehicle on a roadway.

The presence of the ramp vehicle 32 can then be transmitted from the controller 54 by a second cable 56 to a display sign 58 located within the vision of drivers on the freeway 23 such as freeway vehicle 22. The display sign 58 should be positioned sufficiently prior to the exit 40 of the access ramp 36 so that sufficient time is allowed for the freeway vehicle 22 to react without abrupt manuevers to avoid collision with the ramp vehicle 32. As illustrated in FIG. 1B, the display sign 58 is positioned before the apex 26 of the overpass 20.

Figure 2:
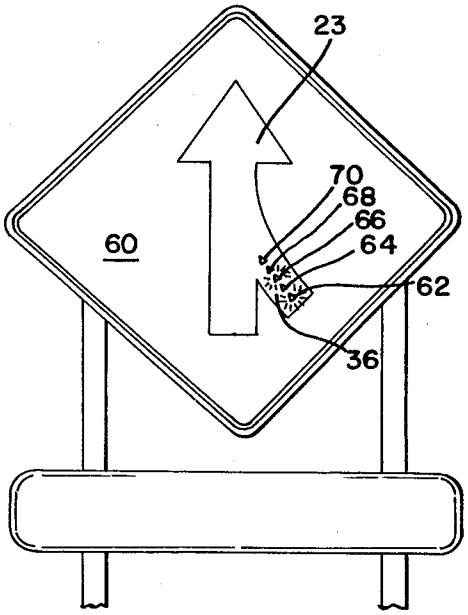
FIG. 2 is a standard roadway merge sign modified in accordance with the present invention to dynamically represent merging traffic on an access ramp.

FIG. 2 illustrates a standard roadway merge sign 60 identified by the Illinois Department of Transportation as symbol W4 - 1 graphically displaying the access ramp 36 merging onto the freeway 23. The merge sign 60 has been modified by the addition of icons 62, 64, 66, 68 and 70. Each icon such as 62 is illuminated when its corresponding detector 42 senses ramp vehicle 32 (not shown). Similarly, each of the other icons 64, 66, 68 and 70 are illuminated as the ramp vehicle 32 is sensed by corresponding detectors 44, 46, 48 and 50. In this figure icons 62 and 66 are illuminated or otherwise energized to depict the positions of vehicles 32 and 33 respectively at detectors 42 and 46, respectively. Thus, information is transmitted to any freeway vehicles of the approach of the ramp vehicle 32 to the junction so that appropriate action can be taken by the freeway drivers even though there is no direct view of the merging ramp vehicle 32.

Figure 3:
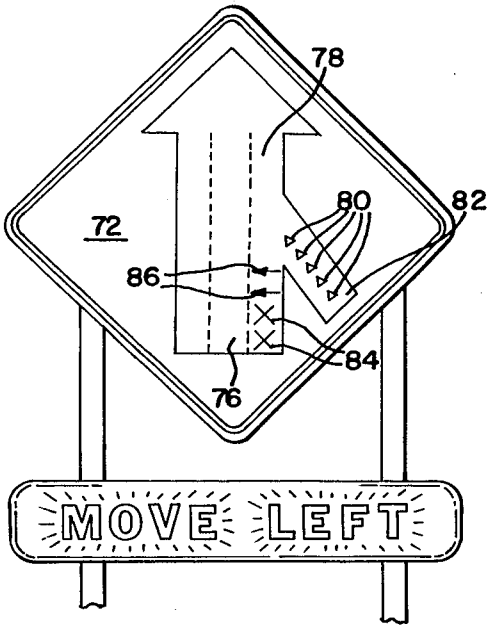
FIG. 3 is a standard roadway merge sign modified in accordance with the prevent invention to dynamically represent merging traffic on an access ramp and regulatory signals displayed to freeway traffic.

FIG. 3 illustrates a standard roadway merge sign 72 further modified by the graphic display of multiple freeway lanes 74, 76, 78. As the icons, referred to as 80, display the approach of a vehicle (not shown) on the graphically displayed access ramp 82, advisory signals 84 and 86 are illuminated to guide traffic in freeway lane 78 into freeway lane 76 to allow traffic to merge from the access ramp 82 without mishap. Although "x"'s and arrows are illustrated to signal a lane closure and guide traffic out of freeway lane 78, other symbols may be used to convey the message to freeway drivers. The present invention is not limited to the use of abstract symbols. Words, whether illuminated or not, may also be used to convey this information to the freeway drivers. Although the information to the freeway drivers in this illustration to merge from freeway lane 78 is advisory it can be made mandatory as part of the traffic regulation or code. Also illustrated in FIGS. 2 and 3 is a contemplated modification including a display of a directional word message which may be illuminated or otherwise activated to convey information to motorists approaching the junction, as further described below.

Figure 4:
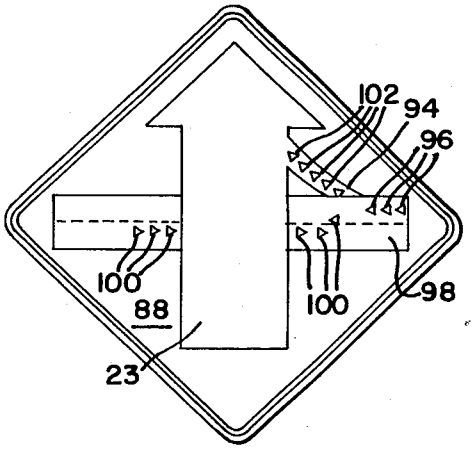
FIG. 4 is a standard roadway merge sign modified in accordance with the present invention to dynamically represent merging traffic on an access ramp and side roads.

FIG. 4 is still another adaptation of the standard roadway merge sign 88 modified by the graphic display of a sideroad 90. The density of traffic on sideroad lane 92 feeding onto the access ramp 94 is displayed by the illuminator of icons, referred to as 96. Similarly, traffic in sideroad lane 98 feeding onto the access ramp 94 from the opposite direction is displayed by a second plurality of icons 100. As the vehicles enter the access ramp 94 their progress is displayed in the manner previously discussed by the icons referred to as 102.

Figure 5:
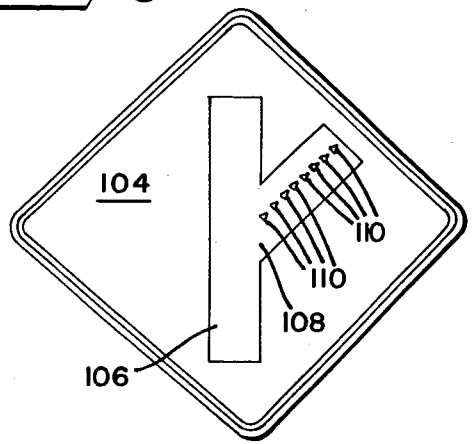
FIG. 5 is a standard roadway exit sign modified in accordance with the present invention to dynamically represent departing traffic on an exit ramp.

FIG. 5 illustrates a standard roadway exit sign 104 graphically displaying a freeway 106 and an exit lane 108. As a vehicle (not shown) leaves the freeway 106, each of the icons, generally referred to as 110, would successively be illuminated in the manner previously discussed to indicate progress of the vehicle off the freeway 106. Should traffic begin to "back up" on the exit lane 108, due to some delay further on, the icons would stay illuminated indicating that the exit lane 108 is filling with stopped vehicles. This information displayed to the approaching freeway drivers would give them additional time to slow down and avoid rear-end collisions. This would be especially true if the next lane 108 is not directly visible to the freeway 106 until the vehicle actually enters the exit lane 108. FIG. 5 demonstrates the flexibility of the present invention for adaptation to various traffic control situations.

Figure 6:
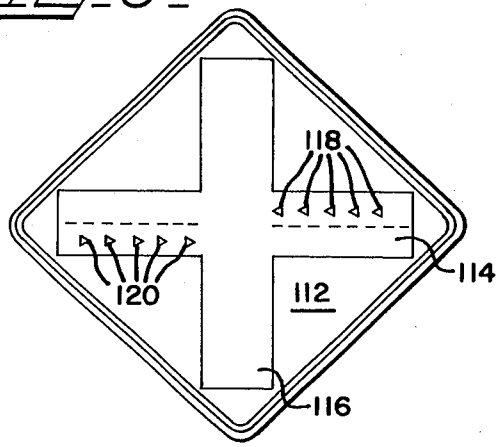
FIG. 6 is a standard roadway crossroad sign modified in accordance with the present invention to represent conflicting traffic approaching a crossrad junction.

FIG. 6 is a standard roadway crossroad sign 112 identified by the Illinois Department of Transportation as symbol W2 - 1 graphically displaying a crossroad 114 intersecting a freeway 116. The crossroad sign 112 has been modified by the addition of two plurality of icons, generally referred to as 118 and 120. As the individual icons 118 and 120 are illuminated in the manner previously discussed, the approach of vehicles on the crossroad 114 toward the freeway 116 from either direction will advise the freeway vehicles on avoiding a collision. The crossroad sign 112 may be modified with only one plurality of icons or may include other traffic control signs like "yield" or "stop" graphically displayed.

Figure 7:
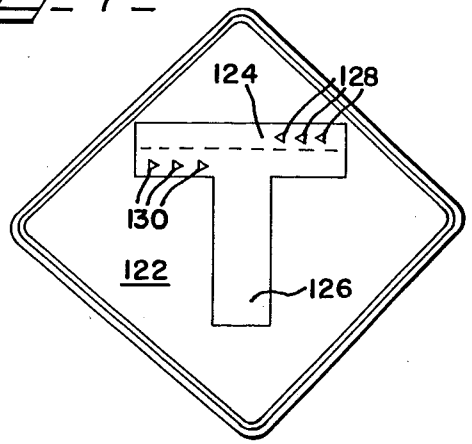
FIG. 7 is a standard roadway T-intersection sign modified in accordance with the present invention to represent conflicting traffic approaching a T-intersection junction.

FIG. 7 is a standard roadway T-intersection sign 122 identified by the Illinois Department of Transportation as symbol W2-4 graphically displaying a crossroad 124 intersecting the stem of the T 126 The T-intersection sign 122 has been modified with the addition of a plurality of icons referred to as 128. As the individual icons 128 are illuminated in the manner previously discussed, vehicles on the stem road 126 would be alerted to vehicles approaching the junction on crossroad 124 so that collisions would be avoided as vehicles turn from the stem road 126 onto the crossroad 128. should the crossroad 124 be a two-way roadway, it may be desireable to have a second plurality of icons 130 to display the approach of the vehicles to the junction from the opposite direction.

Figure 8:
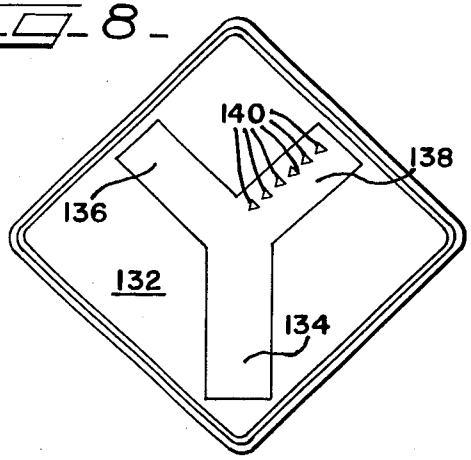
FIG. 8 is a standard roadway Y-intersection sign modified in accordance with the present invention to represent merging traffic approaching a Y-intersection junction.

FIG. 8 is a standard roadway Y-intersection sign 132 identified by the Illiniois Department of Transportation as symbol W2-5 graphically displaying a Y-stem road 134 and two channel roads 136 and 138. The Y-intersection sign 132 has been modified with the addition of a plurality of icons referred to as 140. As the individual icons 140 are illuminated in the manner previously discussed, vehicles on the stem road 134 would be alerted to vehicles approaching the junction on channel road 138 so that collisions would be avoided as vehicles turn from the stem road 134 onto the opposite channel road 136.

Figure 9:
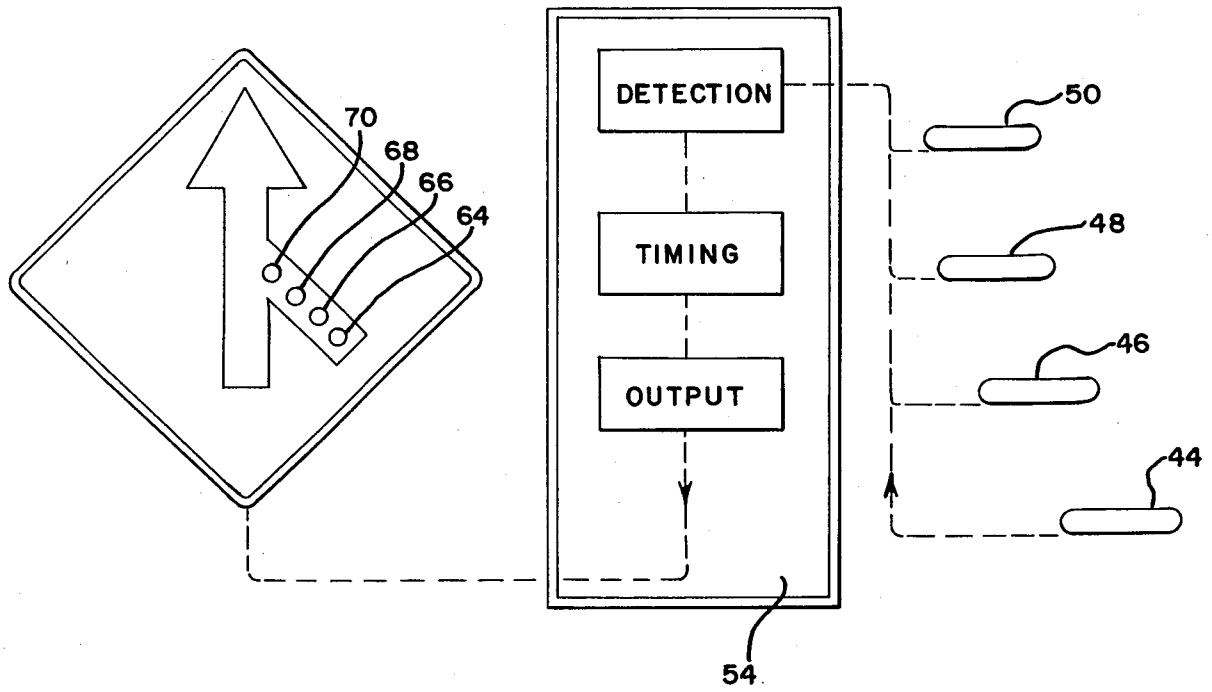
FIG. 9 is a schematic diagram of the embodiment of the invention shown in FIGS. 1A and 1B showing the flow of detected information.

FIG. 9 is a block diagram illustrating the flow of detected information about vehicles on the side paths from the detectors through the controller and on to the sign for display. Detectors 44, 46, 48 and 50 are monitored by the controller for activity. The sensitivity of the detectors is set to disregard small nonmotorized conveyances such as bicycles or strollers that may share the use of part of a monitored roadway and trigger irrelevant inputs. In the simplest one to one correspondence of detector to icon, detector 44 will activate icon 64 thereby showing the relative position of the vehicle on the side path in that same relative position on the displayed side path of the sign. As the vehicle progresses along the access ramp it is detected successively by detectors 46, 48 and 50. The displayed presence is perceived both as motion and a statement of relative position by the viewing driver approaching the sign and is an accurate and credible substitute for the visual information that is lacking because of the hidden entrance ramp.

The duration of the activation or illumination of an icon is directly proportional to the speed of the vehicle passing over the detector and would not therefore always be useful as a displayed indicator of presence and activity especially if there were long distances between the detectors; the icons would be activated only briefly with long pauses between activations and the system would not be as useful for obscured lines of sight. Added to this is the problem of multiple vehicle triggering of the detectors that would appear to an observing driver to be a random or chaotic display. Each ramp vehicle reaching 44, 46, 48 and 50 would correctly activate that correpsonding icons 64, 66, 68 and 70, but depending upon the speed and spacing and count of the vehicles subsequent visual patterns may not be a realistic emulation of the motion and presence of vehicles on the ramp.

To keep the display information accurate and credible the detector inputs are presented to the controller 54 rather than connected directly to the sign icons. The block diagram shows the controller having the task of shaping the information into a consistent and understandable display presentation by those icons. This is important in that the approaching drivers are always allowed the opportunity to verify the accuracy of the system's display when they reach the crest of the hill and can then see the hidden ramp drivers. In this manner the display presents a realistic and dynamic depiction of the relative positions of entering vehicles.

Although the previous illustrations are preferred means of displaying the relative positions of vehicles on a plurality of vehicle paths to a junction other display means are contemplated by the present invention. Adaptation of traffic signs already well-known to drivers eliminates the need to re-educate the public. However, development of new signs incorporating this display means is not excluded from the present invention. Additionally, other well-known traffic signs, not specifically illustrated herein, may be modified in accordance with the present invention.

The use of triangular-shaped icons is not a limitation of the present invention. Other symbols may be as readily used to display the position of a vehicle to the junction. Similarly, the number of icons used is adaptable to the particular traffic situation.

Modifications and variations of the present invention are possible in light of the above teachings. It is, therefore, to be understood that within the scope of the appended claims the invention may be practiced otherwise than as specifically described.

I claim:

1. A traffic control system for a traffic junction between a plurality of vehicle paths comprising: first means for detecting the position of a first vehicle along a first vehicle path relative to the junction; means for graphically displaying the junction, the plurality of vehicle paths and the relative position of the first vehicle to the junction whereby vehicles on the second vehicle path approaching said junction do not require a direct view of the first vehicle before the first vehicle enters the junction to avoid collision with said first vehicle.

2. A traffic control system as defined in claim 1 wherein said displaying means further comprises means for displaying the relative positions of a plurality of vehicles on said first vehicle path.

3. A traffic control system as defined in claim 1 wherein said displaying means displays the relative position of said first vehicle when said first vehicle occupies said frist detecting means and ceases displaying said position when said first vehicle leaves said first detecting means.

4. A traffic control system as defined in claim 1 wherein said first detecting means further comprises means for continually updating said displaying means to dynamically represent the real time and relative positions of vehicles on said first vehicle path.

5. A traffic control system as defined in claim 1 wherein said system further comprises at least one side vehicle path connecting a stream of vehicles onto said first vehicle path, each of said side vehicles paths having means for detecting positions of vehicles along the side vehicle path, with said displaying means displaying representations of each of said side vehicle paths and the relative positions of vehicles on said side vehicle paths relative to the first vehicle path.

6. A traffic control system as defined in claim 1 wherein said displaying means further includes a directional message to a second vehicle on said second vehicle path to advise of corrective action needed for a safe merge.

7. A traffic control system as defined in claim 1 wherein said displaying means comprises a standard roadway merge sign graphically displaying a merge junction and first and second vehicle paths modified with a plurality of icons positioned along the display of the first path, each of said plurality of icons energizable to indicate the presence of a vehicle in a corresponding position relative to the junction, said first detecting means having a plurality of detectors corresponding to said plurality of icons for detecting the position of a vehicle.

8. A traffic control system as defined in claim 7 where said merge sign further includes a graphic display of at least one side road connecting to said first path, said display of said side road having a second plurality of icons positioned along said side road, each of said icons energizable to indicate the presence of a vehicle at a corresponding position on said side road, said side road having a plurality of detectors for detecting the position of a vehicle corresponding to said plurality of icons.

9. A traffic control system as defined in claim 6 wherein said directional message further comprises a displayed word message visible to vehicles on said second vehicle path, said word message being energizable when a pre-determined configuration of vehicles exists on said first vehicle path.

10. A traffic control system as defined in claim 1 wherein said displaying means comprises a standard roadway exit sign graphically displaying an exit junction, said sign modified with a plurality of icons positions along a representation of said first vehicle path comprising an exiting path, each of said energizable icons to indicate the presence of a vehicle in a corresponding position on said exiting path.

11. A traffic control system as defined in claim 1 wherein said displaying means includes a standard roadway intersection sign graphically displaying an actual intersecton of first and second vehicle paths, said sign modified with a plurality of icons positioned along the displayed first path, each of said icons energizable to indicate the presence of a vehicle in a corresponding position relative to the intersection, said first detecting means having a plurality of detectors corresponding to said plurality of icons for detecting the position of a vehicle.

12. A dynamic roadway junction sign comprising a graphic display of a corresponding actual junction and plurality of vehicle paths converging at said junction; a plurality of icons positioned in sequence in one of said displayed vehicle paths, each of said icons corresponding to a position along said vehicle path and energizable to represent the relative position of a vehicle to the junction.

13. A dynamic roadway junction sign as defined in claim 12 wherein said junction sign is a standard roadway merge sign.

14. A dynamic roadway junction sign as defined in claim 12 wherein said junction sign is a standard roadway exit sign.

15. A dynamic roadway junction sign as defined in claim 12 wherein said junction sign is a standard roadway crossroad sign.

16. A dynamic roaway junction sign as defined in claim 12 wherein said junction sign is a standard roadway T-intersection sign.

17. A dynamic roadway junction sign as defined in claim 12 wherein said junction sign is a standard roadway Y-intersection sign.

* * * * *